US006374588B1

(12) United States Patent
Nakaji

(10) Patent No.: US 6,374,588 B1
(45) Date of Patent: Apr. 23, 2002

(54) HAIRINESS CONTROLLING DEVICE AND WINDER

(75) Inventor: Fumiaki Nakaji, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/677,874

(22) Filed: Oct. 3, 2000

(30) Foreign Application Priority Data

Oct. 13, 1999 (JP) ..... 11-290658
Oct. 13, 1999 (JP) ..... 11-290659
Oct. 13, 1999 (JP) ..... 11-290660

(51) Int. Cl.[7] ..... D02G 1/04

(52) U.S. Cl. ..... 57/339; 57/78; 57/83; 57/92; 57/93; 57/284; 57/318; 57/328; 57/331; 57/332; 57/334; 57/337; 57/338; 57/340; 57/352; 57/353

(58) Field of Search ..... 57/78, 83, 92, 57/93, 284, 318, 328, 331, 332, 334, 337, 338, 339, 340, 352, 353

(56) References Cited

U.S. PATENT DOCUMENTS 4,383,405 A 5/1983 Bauer et al.
5,966,918 A * 10/1999 Kino et al. ..... 57/264
6,199,361 B1 * 3/2001 Yakushi et al. ..... 57/332
6,279,307 B1 * 8/2001 Nakaji et al. ..... 57/334

* cited by examiner

*Primary Examiner*—John J. Calvert
*Assistant Examiner*—Shaun R Hurley
(74) *Attorney, Agent, or Firm*—Armstrong, Westerman & Hattori, LLP

(57) ABSTRACT

It is an object of the present invention to provide a hairiness controlling device that can start, simultaneously with the start of spun yarn running, stabilizing a spun yarn run through disks. According to the present invention, a rotation speed of each disk 6 is varied depending on a running speed of a spun yarn Y run as a drive drum D rotates, thereby setting the tension of the spun yarn Y at an appropriate value when the spun yarn starts to run.

4 Claims, 12 Drawing Sheets

HAIRINESS CONTROLLING DEVICE AND WINDER

FIELD OF THE INVENTION

The present invention relates to a hairiness controlling device for a spun yarn (hereinafter simply referred to as "yarn") in a winder such as an automatic winder, and a winder such as an automatic winder having the hairiness controlling device and a doffing device.

BACKGROUND OF THE INVENTION

For example, a supply bobbin produced by a ring spinning is transferred to an automatic winder, which detects a defect in the yarn while joining yarns from a large number of supply bobbins to rewind them into corn- shaped or cheese-shaped packages. This rewinding by the automatic winder is a process for tensioning the yarn unwound from the supply bobbin while using a large number of yarn guides to guide the yarn to form a package. Thus, a yarn formed by twisting short fibers is subjected to friction each time it passes through the yarn guide, thereby, after rewinding, increasing the amount of hairinesses present in the yarn in the supply bobbin before rewinding.

Thus, for a rewinding process by a winder such as an automatic winder, a hairiness controlling device is provided in a yarn running path to suppress hairinesses. A hairiness controlling device has been proposed which rotates a plurality of friction disks to falsely twist a yarn run through the disks to intertwine hairinesses with fibers in order to suppress the hairinesses. This hairiness controlling device rotates each disk for false twisting while simultaneously feeding a yarn so that the tension of the yarn rewound into a package is controlled based on a rotation speed of each disk and a running speed of the yarn.

When running of the yarn and rotation of each disk are started simultaneously with the start of rewinding, the yarn may jump out from between the disks unless the tension of the yarn is controlled to an appropriate value.

This is because immediately after the start of rewinding, the yarn is subjected to a very low tension and is thus moved in such a manner as to follow rotation of each disk. Thus, if the yarn jumps out from between the disks, a hairiness suppressing process cannot be carried out and the yarn cannot be continuously rewound.

In addition, an automatic winder forms a package by rewinding a yarn around a winding bobbin gripped by a cradle, the yarn having its hairinesses suppressed by a hairiness controlling device, and performs a doffing operation when the package becomes full. The doffing operation in the automatic winder is started when the package becomes full. Once the package has become full, winding of the yarn is suspended. Subsequently, the yarn is cut between the supply bobbin and the package, and the full package is unloaded from the cradle, which is supporting the package. Subsequently, a new winding bobbin is installed on the cradle, and a yarn threading operation is performed to install the yarn from the supply bobbin on the new winding bobbin. The yarn remains threaded through the hairiness controlling device at least during the yarn threading operation of the doffing operation.

When, however, the yarn from the supply bobbin side is moved for the doffing operation (the yarn threading operation), the yarn may be broken due to a contact resistance with each disk of the hairiness controlling device. The breakage of the yarn affects the doffing operation (yarn threading operation) performed by the automatic winder.

It is an object of the present invention to provide a hairiness controlling device that can start, simultaneously with the start of yarn running, stabilizing a yarn run through disks.

It is another object of the present invention to provide a winder comprising a hairiness controlling device and which can perform a smooth doffing operation.

SUMMARY OF THE INVENTION

A hairiness controlling device according to the present invention rotates a plurality of disks to falsely twist a spun yarn run through the disks while applying a feeding force to the yarn. With this hairiness controlling device, simultaneously with the start of running of the yarn, an operation is started for varying a rotation speed of each of the disks depending on a running speed of the yarn.

Simultaneously with the start of running of the yarn, the operation is started for varying the rotation speed of each of the disks depending on the running speed of the yarn, thereby setting the tension of the yarn at an appropriate value at the start of the running.

With a hairiness controlling device according to the present invention, the rotation speed of each of the disks is raised as the running speed of the yarn rises.

While keeping the tension of the yarn at an appropriate value, the rotation speed of each disk and the running speed of the yarn can be raised to corresponding values required for yarn rewinding.

The tension of the yarn arises from the rotation speed of each disk and the running speed of the yarn; the yarn is tensed to increase its tension when the difference between a feeding speed (low) of the yarn corresponding to the rotation speed of each disk and the running speed (high) of the yarn is increased. Accordingly, if the yarn is tensed immediately after the start of yarn running by lessening the rotation speed of each disk in proportion to the running speed of the yarn, the tension of the yarn can be rapidly raised to an appropriate value.

With a hairiness controlling device according to the present invention, each of the disks is rotated at a low speed before the yarn starts to run.

Each of the disks is rotated at a low speed before the yarn starts to run, thereby reducing yarn breakage caused by a contact resistance between the yarn and each disk when the yarn starts to run.

A hairiness controlling device according to the present invention has a member for acting on and bending a preceding part of the yarn run through the disks.

By bending the yarn when it starts to run, the tension of the yarn can be rapidly raised to an appropriate value.

The hairiness controlling devices according to the above inventions are applied to a winder for forming a package by winding the yarn unwound from a supply bobbin, around a winding bobbin rotated by drive means. These hairiness controlling devices provide high effects particularly when applied to an automatic winder comprising a yarn monitor for detecting a yarn defect and a yarn joining device for joining a yarn end on a supply bobbin side and a yarn end on a package side together.

A hairiness controlling device according to the present invention rotates a plurality of disks to falsely twist the yarn run through the disks while applying a feeding force to the yarn, and has guide means for holding the yarn in a central portion between the disks when the yarn starts to run.

By using the guide means to hold the yarn when the yarn starts to run, the yarn run through the disks is stabilized.

With a hairiness controlling device according to the present invention, after the yarn has started to run, the guide means is inactivated when the tension of the yarn has reached an appropriate value. Once the tension of the yarn has reached an appropriate value, the yarn runs stably through the disks. While the yarn is running stably, the guide means is inactivated to stop contacting with the yarn, thereby preventing the yarn from being excessively damaged.

With a hairiness controlling device according to the present invention, the guide means pushes the yarn into the central portion between the disks before the start of running of the yarn.

By pushing the yarn into the central portion between the disks before the start of yarn running, the yarn can start to run more stably. If the disks are rotated at a low speed when the yarn is pushed in, yarn breakage can be prevented during the push-in operation.

The hairiness controlling devices according to the above inventions are applied to a winder for forming a package by winding the yarn unwound from a supply bobbin, around a winding bobbin rotated by drive means. These hairiness controlling devices provide high effects particularly when applied to an automatic winder comprising a yarn monitor for detecting a yarn defect and a yarn joining device for joining a yarn end on a supply bobbin side and a yarn end on a package side together.

A winder according to the present invention comprises a hairiness controlling device having a plurality of disks and a doffing device, the doffing device performing a doffing operation with the yarn threaded through the hairiness controlling device, the yarn connecting to a supply bobbin. With this winder, when the yarn threaded through the hairiness controlling device is moved during the doffing operation, the disks of the hairiness controlling device are rotated.

By rotating each disk when the yarn is moved during the doffing operation, the contact resistance between each disk and the yarn run through the disks is lowered to reduce yarn breakage occurring when the supply-side yarn is moved through the disks.

With a winder according to the present invention, each disk is rotated at a lower speed than during normal winding when the yarn is moved during the doffing operation.

Since the yarn moves at a low speed during the doffing operation, each disk is rotated at a low speed to set the tension of the yarn at an appropriate value.

With a winder according to the present invention, rotation of each disk is started simultaneously with the start of the doffing operation.

The rotation of the disks is started simultaneously with the start of the doffing operation, thereby eliminating the necessity of complicated control.

BRIEF DESCRIPTION OF THE INVENTION

DETAILED DESCRIPTION OF THE PREFERRED EMBODIMENTS

A hairiness controlling device according to embodiments of the present invention will be described with reference to FIGS. 1 to 4.

Figure 1:
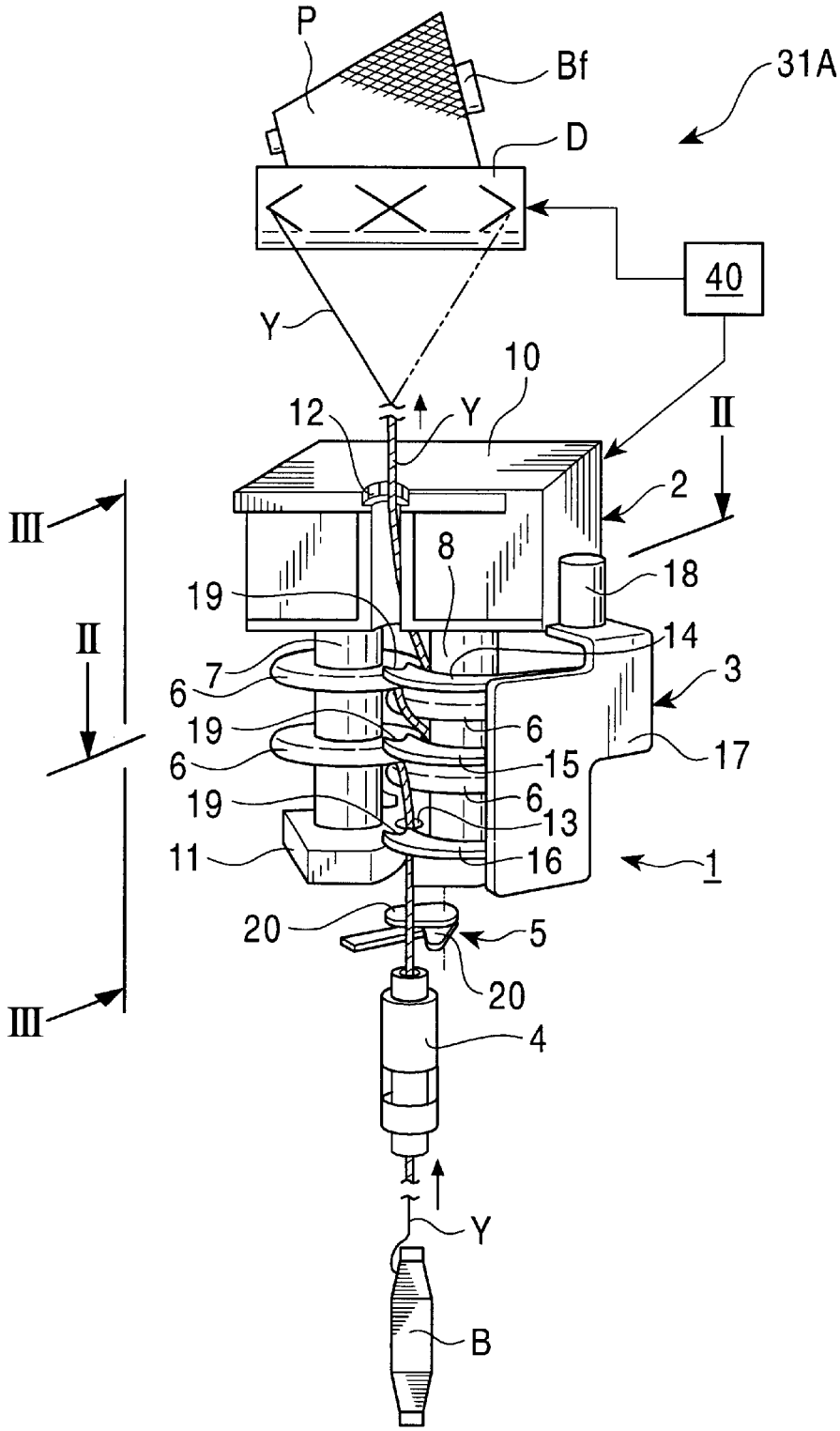
FIG. 1 is a perspective view showing a hairiness controlling device according to the present invention.

The hairiness controlling device 1 shown in FIG. 1 is provided in a winder 31A such as an automatic winder, and falsely twists a spun yarn Y (hereinafter simply referred to as "yarn") unwound from a supply bobbin B and wound around a winding bobbin Bf into a package P, while simultaneously applying a feeding force to the yarn Y. The winder shown in FIG. 1 comprises the winding bobbin Bf around which the yarn Y from the supply bobbin B is wound, and a drive drum D for rotating the winding bobbin Bf. When the yarn Y is wound around the winding bobbin Bf, the package P is formed. When the package P is formed, the drive drum D comes in contact with the package P to rotate it. The drive drum D has a traverse groove formed therein and is formed into a traverse drum also acting as a traverse device. A hairiness controlling device 1 is located in a yarn running path between the drive drum D for rotating the package P and the supply bobbin B, and comprises a false twisting device 2, a yarn holding guide 3 acting as guide means, a twist stopping device 4 and a gripping guide 5.

Figure 2:
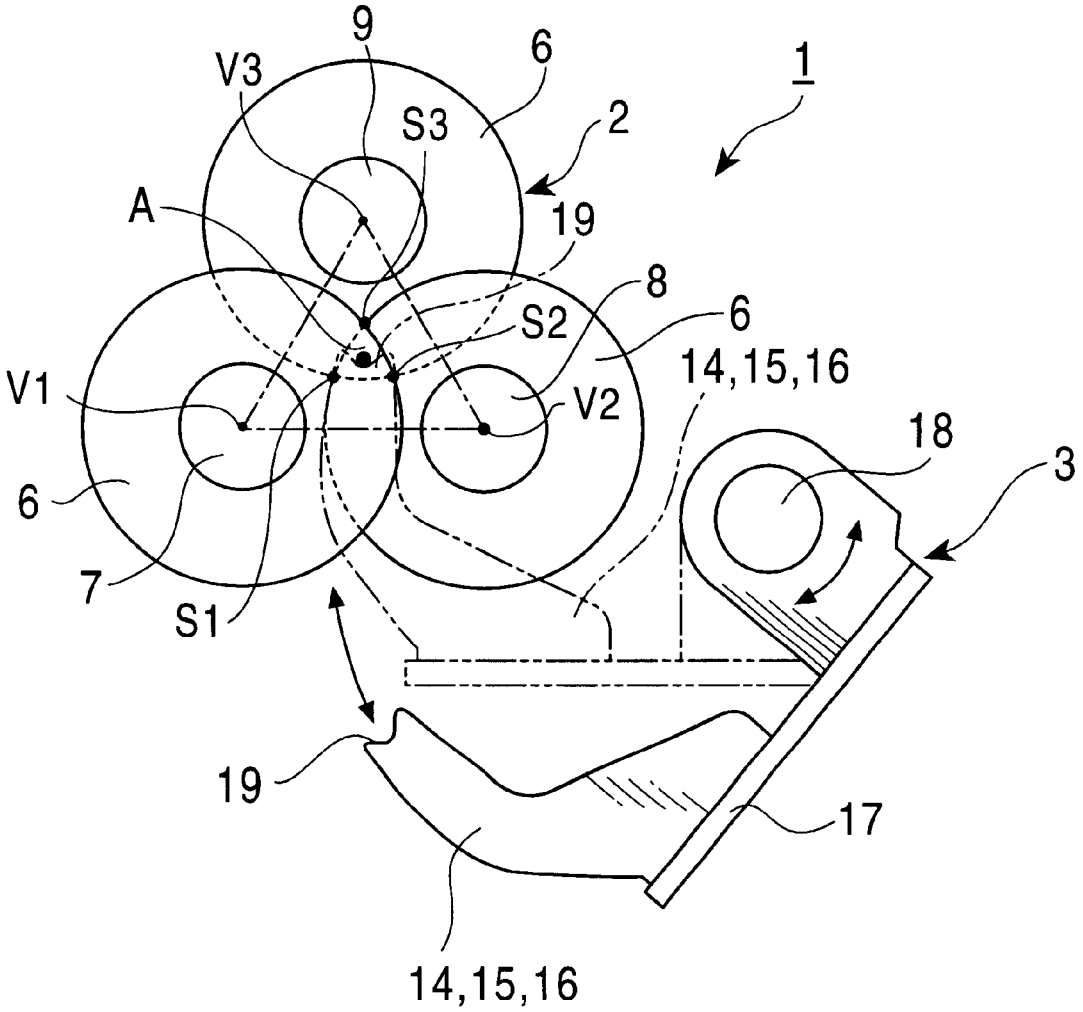
FIG. 2 is a view taken along line II—II in FIG. 1.
Figure 3:
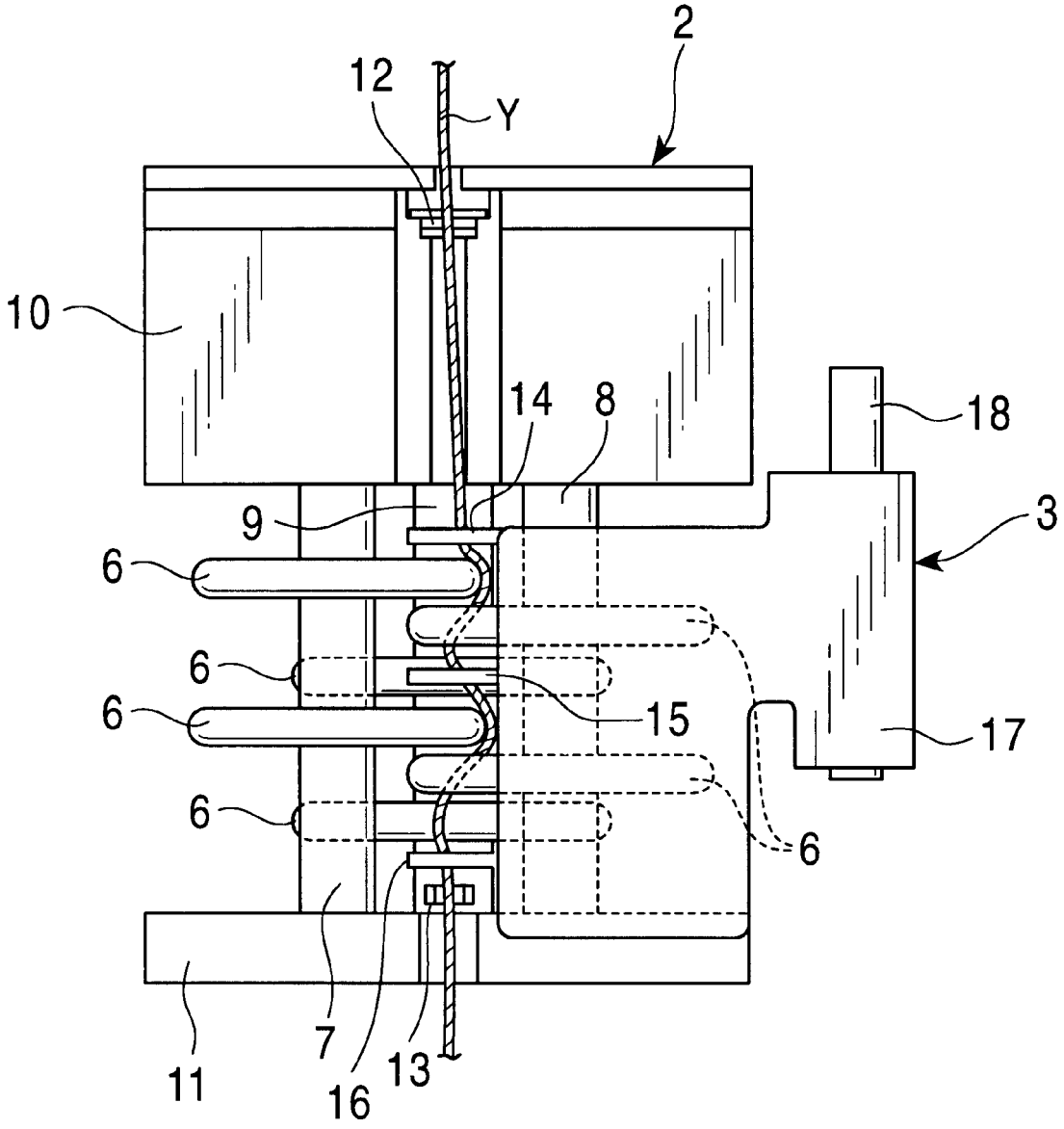
FIG. 3 is a view taken along line III—III in FIG. 1.

The false twisting device 2 comprises a plurality of (in the illustrated example, 6) friction disks 6 and three shafts including a first to third shafts 7 to 9, as shown in FIGS. 2 and 3. A plurality of (2) friction discs 6 are provided for each of the first to third shafts 7 to 9. The first to third shafts 7 to 9 are supported between a block 10 and a support member 11 and are simultaneously rotated by a drive motor, a belt, and other components (not shown in the drawings) on the block 10 side. In addition, the first to third shafts 7 to 9 are each provided at a vertex V1 to V3 of a regular triangle and are arranged in such a manner that the discs 6 of the different shafts overlap partly in a radial direction of thereof (see FIG. 2). The first to third shafts 7 to 9 have the disks 6 arranged so as to be offset in an axial direction of thereof (see FIG. 3). Then, by rotating the first to third shafts 7 to 9 in the same direction, the yarn Y pushed into a central portion A between the disks 6 and contacted with the disks 6 so as to be bent zigzag is falsely twisted for S-twist or Z-twist. In addition, the yarn Y is fed to the package P simultaneously with the false twisting. The central portion A refers to an inner portion of intersects S1,S2,S3 of the disks 6 of two different shafts of the first to third shafts 7 to 9, the disks overlapping partly in the radial direction (see FIG. 2). 12 and 13 are yarn guides formed in the block 10 and the support member 11, respectively.

The yarn holding guide 3 is provided in the false twisting device 2 and comprises three yarn holding levers 14 to 16 and a support bracket 17, as shown in FIGS. 2 and 3. The yarn holding levers 14 to 16 are each supported by the support bracket 17 and extend between the first shaft 7 and the second shaft 8 of the false twisting device 2 (see FIG. 2). The yarn holding levers 14 to 16 are also arranged at intervals in the axial direction of the first to third shafts 7 to 9 (see FIG. 3). The yarn holding levers 14 to 16 each have a guide groove 19 for capturing and holding the yarn Y. The support bracket 17 is supported by a drive shaft 18, which rotates to pivot each of the yarn holding levers 14 to 16. When each of the yarn holding levers 14 to 16 is pivoted toward the false twisting device 2, the guide groove 19 in each of the yarn holding levers 14 to 16 captures the yarn Y between the lever 14 to 19 and the false twisting device 2 and pushes it in in such a manner that the yarn climbs over each of the disks 6 of the first shaft 7 and the second shaft 8, thereby holding the yarn Y in the central portion A between the disks 6.

The twist stopping device 4 is located between the false twisting device 2 and the supply bobbin B to limit propagation of twisting from the twist stopping device 4 toward the supply bobbin B. By limiting propagation of twisting effected by the false twisting device 2, toward the supply bobbin B, the yarn Y is effectively falsely twisted to suppress hairinesses. In addition, the gripping guide 5 is located between the false twisting device 2 and the twist stopping device 4 and has two gripping plates 20 that are opened and closed to grip and bend the yarn Y before running through the disks 6. Then, the drive drum D is rotated to start the yarn Y running, and the yarn guide 5 then grips and bends the yarn Y to further rapidly raise the tension of the yarn Y to an appropriate value.

The operation of the hairiness controlling device 1 will be explained below with reference to FIG. 4.

Driving of the drive drum D and the hairiness controlling device 1 (the rotation speed of the disks 6 and driving of the yarn holding guide 3) is controlled by a controller 40.

FIG. 1 shows how the yarn Y is wound, that is, the yarn Y is connected between the supply bobbin B and the package P. However, a state where the yarn Y is not connected, that is, a state before the start of rewinding of the yarn Y will be explained below.

Before the yarn Y starts being rewound, the drive drum D is stopped and the yarn holding guide 3 of the hairiness controlling device 1 (see FIG. 2) is inactivated. The yarn Y is then unwound from the supply bobbin B and passed through the twist stopping device 4 and between the false twisting device 2 and the yarn holding guide 3 before connecting to the winding bobbin Bf on the drive drum D. With the yarn Y connected between the supply bobbin B and the package P, the yarn Y is located between the false twisting device 2 and the inactivated yarn holding guide 3. Then, the disks 6 of the false twisting device 2 are each rotated in the same direction at a low speed (#1 in FIG. 4)

In this state, each of the yarn holding levers 14 to 16 of the yarn holding guide 3 is pivoted to capture the yarn Y in the corresponding guide groove 19 and push it in in such a manner that it climbs over each of the disks 6 of the first shaft 7 and the second shaft 8. The yarn Y is thus held in the central portion A between the disks 6 (#2 in FIG. 4; see FIG. 2). When pushed in between the disks 6, the yarn Y is brought into contact with each disk 6 in a fashion being bent zigzag. Additionally, when each disk 6 rotates at a low speed, the yarn Y receives a feeding force from the disk 6 to reduce a contact resistance between the yarn Y and the disk 6.

Subsequently, the drive drum D is rotated to unwind the yarn Y from the supply bobbin B and run it, thereby starting rewinding the yarn Y. The rotation speed of the drive drum D rises with a rapidly increasing linear gradient until it reaches a value required for rewinding. In addition, the rotation speed of each disk 6 is raised with a more gradually increasing linear gradient than the rotation speed of the drive drum D (#3 in FIG. 4).

Then, the yarn Y runs from the supply bobbin B, through the twist stopping device 4, and through the disks 6 of the false twisting device 2, and is then rewound around the winding bobbin Bf into the package P, which is rotated by the drive drum D. When the drive drum D is a traverse drum, the yarn Y is rewound around the winding bobbin Bf while being traversed.

At this point, since a reduced contact resistance occurs between the yarn Y and each disk 6 because the disk 6 rotates at a low speed, the resistance between the disks 6 is kept low to allow the yarn Y to be fed smoothly to the winding bobbin Bf. This serves to reduce the breakage of the yarn Y when rewinding is started. In particular, with a thin yarn Y, the yarn is likely to be broken due to a tension applied when the yarn Y starts to run and due to a rise in tension caused by the resistance between the disks 6. Thus, the yarn breakage can be reduced by rotating each disk 6 at a low speed.

In addition, since the yarn Y is held by the yarn holding levers 14 to 16 of the yarn holding guide 3 when running through the disks 6 of the false twisting device 2, it is ensured to run stably while being falsely twisted by rotation of each disk 6. At this point, the twist stopping device 4 regulates propagation of twisting toward the supply bobbin B, so that the yarn Y is effectively falsely twisted.

Figure 4:
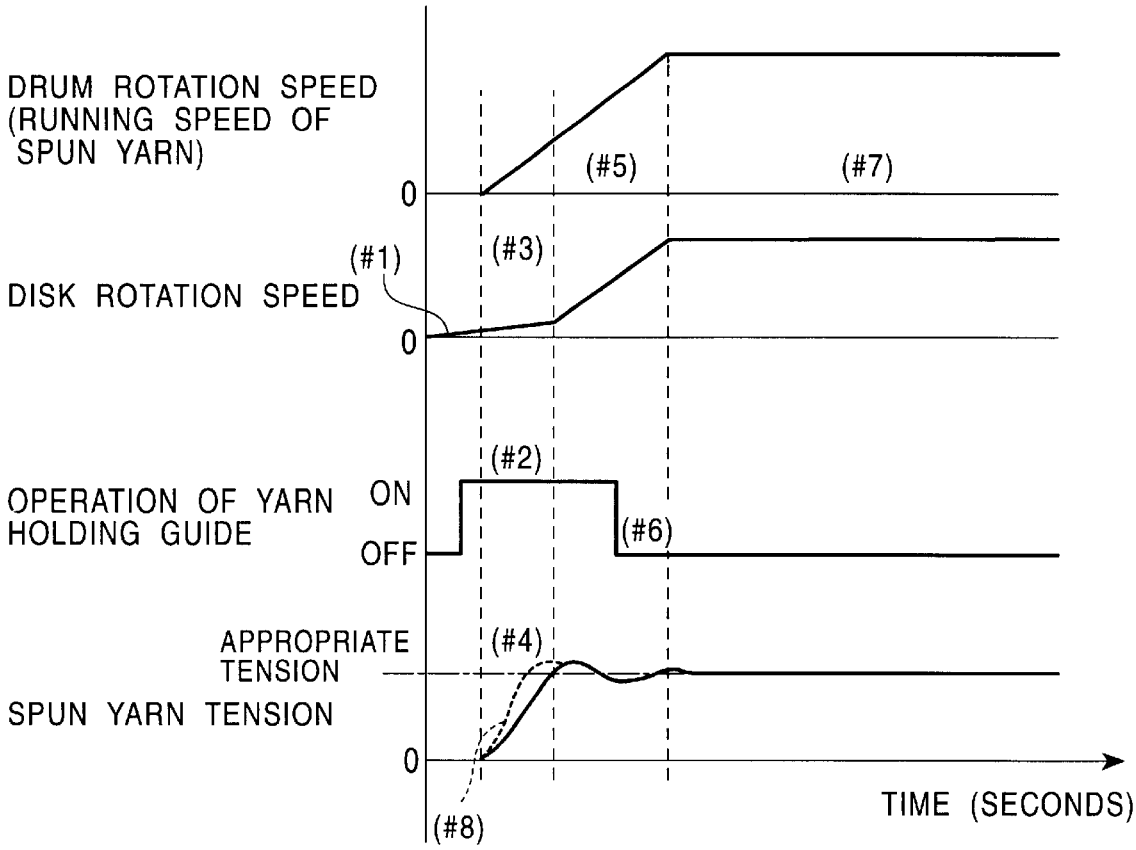
FIG. 4 is a time chart useful in explaining the operation of the hairiness controlling device according to the present invention.

Simultaneously with the false twisting, the yarn Y is fed to the package P as each disk 6 rotates, and is rewound into the package P while maintaining the tension at an appropriate value (#4 in FIG. 4).

The tension of the yarn Y arises from a rotation speed of the disk 6 and a running speed of the yarn Y based on the rotation of the drive drum D. That is, it arises from the amount of feeding of the yarn Y based on the rotation of the disk 6 and from the amount of rewinding of the yarn Y based on the rotation of the drive drum D.

The running speed of the yarn Y will be described below as the rotation speed of the drive drum D.

First, when the difference in rotation speed between the drive drum D and the rotation speed of the disk 6 increases relatively, the amount of rewinding of the yarn Y increases compared to the amount of feeding of the yarn Y, thereby causing the yarn Y to be tensed between the false twisting device 2 and the package P to increase the tension. Alternatively, when the difference in rotation speed decreases relatively, the amount of feeding of the yarn Y increases relatively, thereby causing the yarn Y to be loosened between the false twisting device 2 and the package P to lessen the tension. Consequently, when winding is started, the rotation speed of each disk 6 is raised with a gradually increasing linear gradient while the rotation speed of the drive drum D is raised with a rapidly increasing linear gradient, to rapidly increase the difference in rotation speed between the drive drum D and the disk 6, thereby rapidly raising the tension of the yarn Y.

Subsequently, once the yarn Y rewound into the package P has reached an appropriate tension value, the gradient with which the rotation speed of each disk 6 increases is changed to a rapidly increasing linear one. Thus, simultaneously with the start of running of the yarn Y, an operation is started for raising the rotation speed of each disk 6 as the rotation speed of the drive drum D rises, to rapidly set the tension of the yarn Y at an appropriate value.

The difference in rotation speed between the drive drum D and the disk 6 is subsequently made constant to maintain the tension of the yarn Y at an appropriate value. In addition, applying an appropriate tension allows the yarn Y to run stably through the disks 6 despite a rotational force of each disk 6, thereby preventing the yarn Y from jumping out from the central portion A between the disks 6.

After the running of the yarn Y has been stabilized, each of the yarn holding levers 14 to 16 of the yarn holding guide 3 is pivoted so as to be spaced from the false twisting device 2, thereby releasing the yarn Y (#6 in FIG. 4; see FIG. 2).

Then, the rotation speeds of each disk 6 and the drive drum D are controlled to constant values to maintain the tension of the yarn Y at an appropriate value, while the yarn Y unwound from the supply bobbin B has its hairinesses suppressed and is rewound into the package P.

With the hairiness controlling device 1 according to this embodiment, the tension of the yarn Y can be rapidly set at an appropriate value by starting, simultaneously with the start of running of the yarn Y, to change the rotation speed of each disk 6 depending on the rotation speed of the drive drum D. Applying an appropriate tension allows the yarn Y to run stably despite a rotational force of each disk 6, thereby preventing the yarn Y from jumping out from the central portion A between the disks 6. Consequently, not only the hairiness suppressing process but also rewinding of the yarn Y can be continuously carried out.

In addition, by raising the rotation speed of each disk 6 as the rotation speed of the drive drum D rises, the tension of the yarn Y can be rapidly set at an appropriate value, while the rotation speeds of each disk 6 and the drive drum D can be set at corresponding values required for rewinding. When each disk 6 is rotated at a low speed before the yarn Y starts to run, the yarn Y can be run further stably before starting running.

Further, with the hairiness controlling device 1 according to this embodiment, by starting, simultaneously with the start of running of the yarn Y, to hold the yarn Y using the yarn holding levers 14 to 16 of the yarn holding guide 3, the yarn Y run through the disks 6 can be stabilized and restrained from jumping out from between the disks 6.

In addition, after an appropriate tension has been applied to stabilize the running of the yarn Y, the yarn Y is released from the yarn holding guide 3, which has held the yarn Y. The yarn Y can be prevented from being excessively damaged. Before the yarn Y starts to run, the yarn holding guide 3 pushes the yarn Y in and holds it, thereby allowing the yarn Y to run further stably at the start of running.

The hairiness controlling device 1 according to this embodiment further has the gripping guide 5 for bending the yarn Y. After the drive drum D has rotated to start the yarn Y running, the gripping guide 5 grips and bends the yarn Y to further rapidly raise the tension thereof to an appropriate value (#8 in FIG. 4). Consequently, the yarn Y can be run stably through the disks 6 and prevented from jumping out from the central portion A between the disks 6. The yarn Y is released from the gripping guide 5 when its tension has reached an appropriate value.

Next, an example in which the hairiness controlling device 1 is applied to an automatic winder will be explained with reference to FIGS. 5 and 6.

Figure 5:
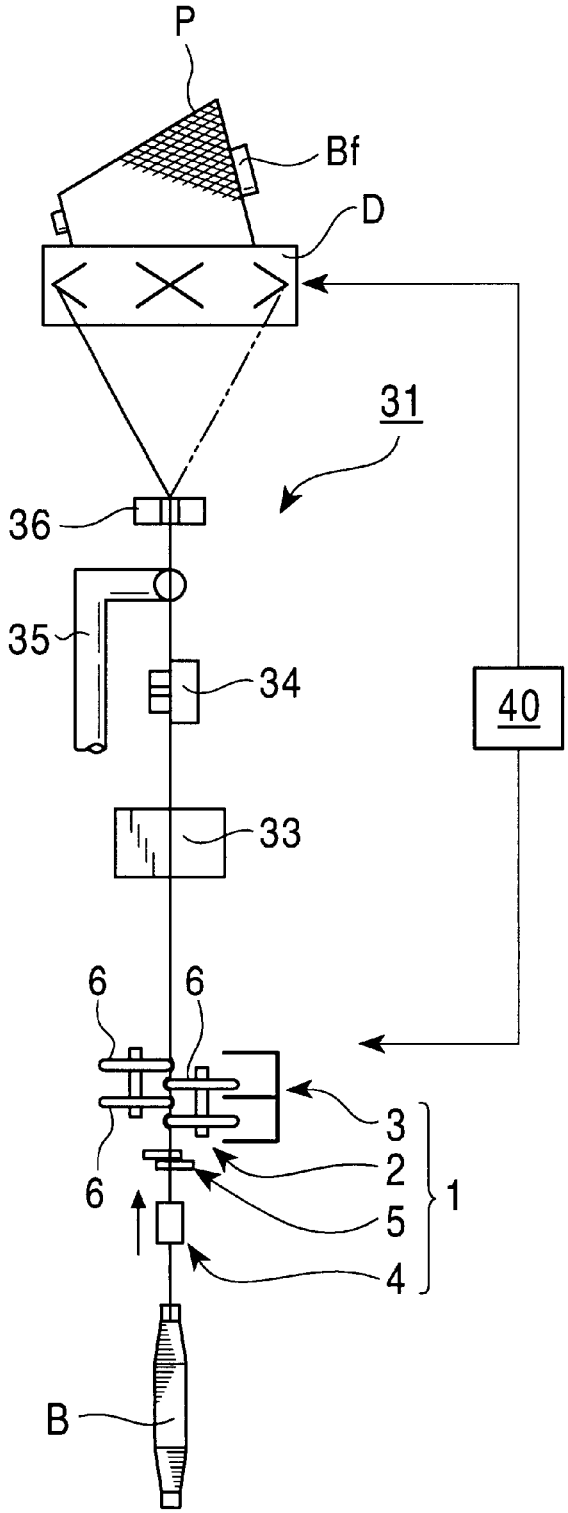
FIG. 5 is a schematic view showing a winding unit of an automatic winder to which the hairiness controlling device according to the present invention is applied.
Figure 6:
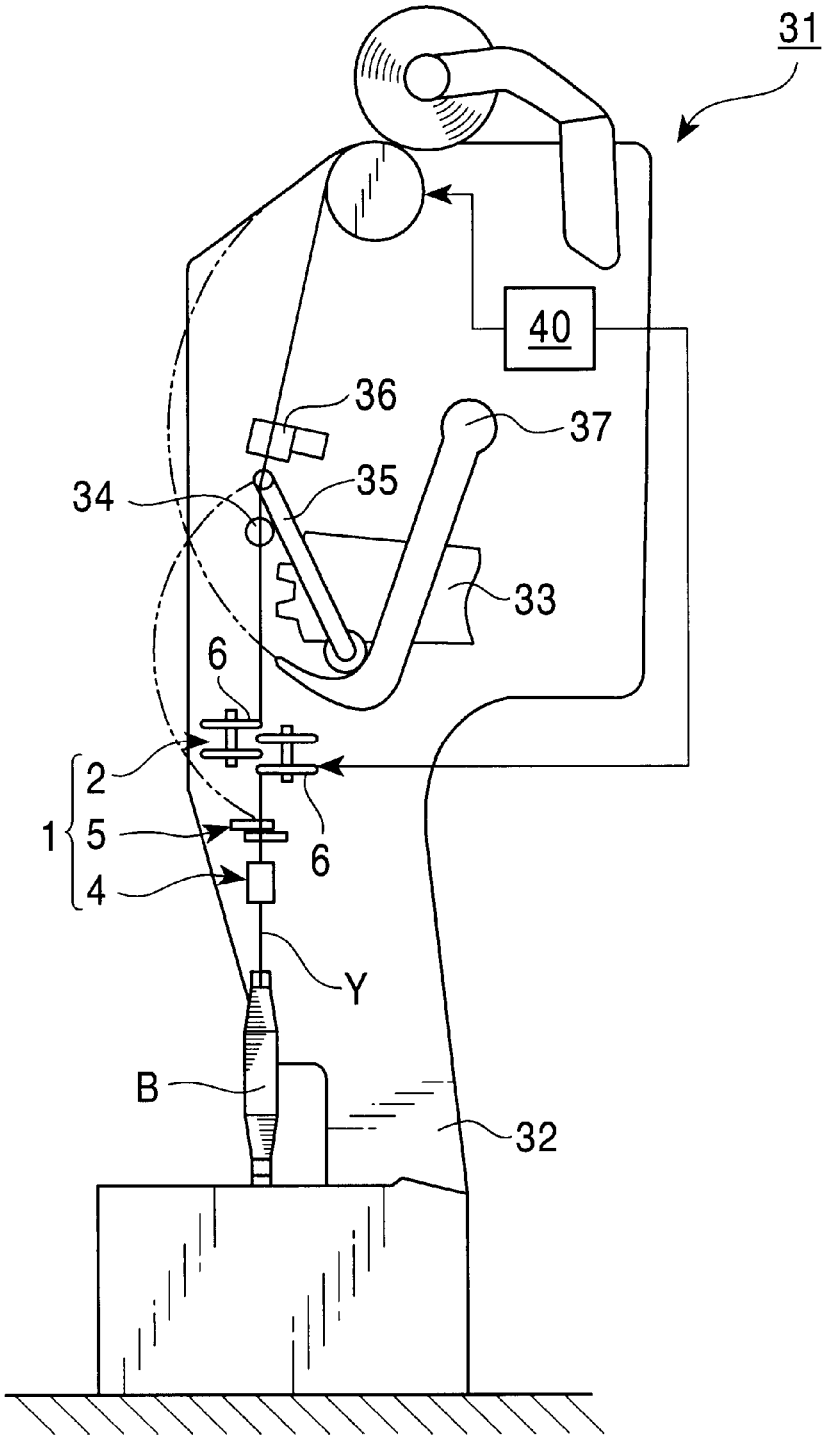
FIG. 6 is side view showing the winding unit of the automatic winder to which the hairiness controlling device according to the present invention is applied.

The automatic winder 31 shown in FIGS. 5 and 6 comprises a large number of winding units 32 arranged in juxtaposition and each including the hairiness controlling device 1 in FIGS. 1 to 3. In addition, in each of the winding units 32, the yarn Y unwound from the supply bobbin B passes through a balloon breaker (not shown in the drawings), the hairiness controlling device 1, a waxing device 34, a slab catcher 36 for detecting a defect in the yarn Y, and other components, before being rewound around the winding bobbin Bf into the package P, the bobbin Bf being rotated by the traverse drum D. 35 is a yarn trap for sucking the yarn Y from between the waxing device 34 and the slab catcher 36 during a standby state. The yarn trap 35 also acts as a relay pipe for introducing a yarn end into a yarn joining device 33 for joining after yarn breakage, the yarn end being sucked and captured on the supply bobbin B side of the false twisting device 2. 37 is a suction mouth for guiding a yarn end on the package P side to the yarn joining device 33.

Additionally, the yarn holding guide 3 of the hairiness controlling device 1 is pivoted by a cam mechanism for driving the devices 33, 34, and 35 and other devices of each winding unit 32. The yarn holding guide 3 uses this cam mechanism to push in and hold the yarn Y between the disks 6 during a series of operations performed before the traverse drum D starts to rotate. After the traverse drum D has started to rotate, the series of operations by the cam mechanism are completed. Then, urging means such as an electromagnet is used to keep the yarn holding guide 3 holding the yarn Y.

Before each winding unit 32 rewinds the yarn after joining following replacing the supply bobbin B with a new one or following forced cutting of a yarn in which a defect has been detected, each disk 6 of the false twisting device 2 is rotated at a low speed and the yarn holding guide 3 pushes the yarn Y in between the disks 6 to hold it in the central portion A therebetween (see FIG. 2). Subsequently, the traverse drum D of each winding unit 32 is rotated to start rewinding the yarn Y. Then, when the yarn Y unwound from the supply bobbin B runs through the hairiness suppressing device 1, the yarn holding guide 3 stabilizes the running, while each disk 6 rotates to falsely twist the yarn Y, which also has its hairinesses suppressed. At the same time, by adjusting the rotation speeds of each disk 6 and the traverse drum D, the tension of the yarn Y is raised rapidly to an appropriate value to stabilize the running of the yarn Y. In addition, the gripping member 5 grips and bends the yarn Y to rapidly raise the tension of the yarn Y to an appropriate value (see FIG. 4). Once the tension of the yarn Y has reached an appropriate value, the yarn holding guide 3 starts to release the yarn Y, which has been held thereby, and the gripping member 5 starts to release the yarn Y, which has been gripped thereby. At the same time, by adjusting the rotation speeds of each disk 6 and the traverse guide D, the tension of the yarn Y is maintained at an appropriate value, while the above rotation speeds are set at corresponding fixed values for rewinding. The yarn Y is thus traversed by the traverse drum D and simultaneously rewound into the package P.

Thus, even if the hairiness controlling device 1 according to the present invention is applied to the automatic winder 31, since the yarn holding guide 3 holds the yarn Y and the tension of the yarn Y is rapidly raised to an appropriate value based on the rotation speeds of the disk 6 and the traverse drum D, the yarn Y can be stably run through the disks 6 at the start of running of the yarn Y, thereby preventing the yarn Y from jumping out from between the disks 6.

Accordingly, before the yarn Y starts to run, the yarn holding guide 3 pushes the yarn Y into the central portion A between the disks 6, which are rotating at a low speed. The contact resistance between the yarn Y and the disk 6 is thus lowered to prevent yarn breakage during the push-in. Starting to run the yarn Y in this state enables the yarn Y to run stably and reduces the breakage of the yarn Y caused by the contact resistance between the yarn Y and each disk 6. Driving of the traverse drum D, the rotation speeds of the disks 6 of the hairiness controlling device 1, and driving of the cam mechanism are controlled by the controller 40.

In the above described example, the hairiness controlling device 1 is used as a hairiness suppressing device, but the present invention is applicable to a hairiness generating device for roughening a surface of each disk to generate hairinesses.

Figure 7:
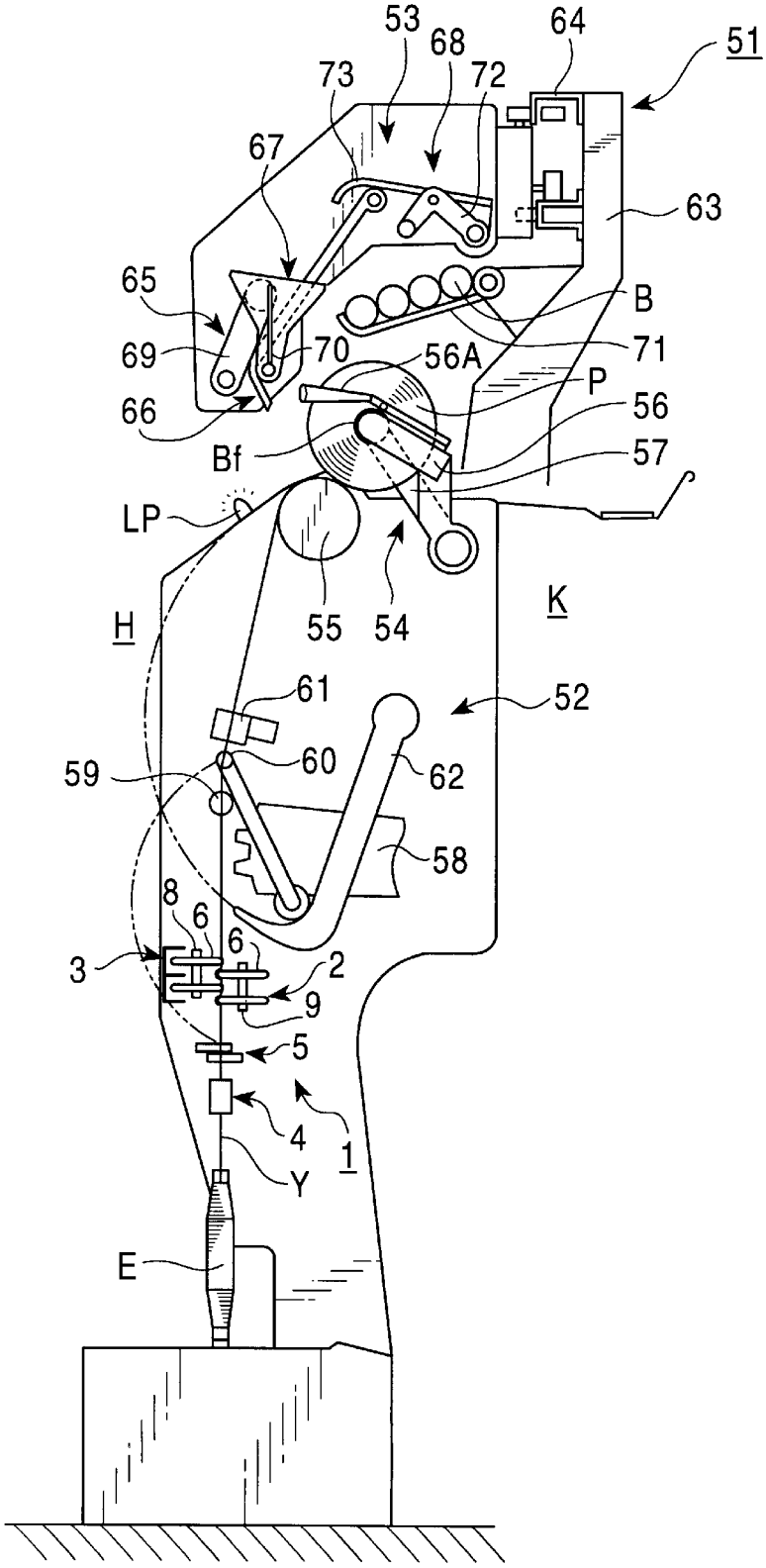
FIG. 7 is a side view showing an automatic winder that is an example of a winder according to the present invention.

The above described hairiness controlling device 1 is further provided in the automatic winder 51 shown in FIG. 7. The automatic winder in FIG. 7 is composed of a large number of winding units 52 arranged in juxtaposition and a doffing device 53.

Each winding unit 52 performs a rewinding operation for rewinding each of the yarns Y unwound from one or many supply bobbins E, around the corresponding winding bobbin Bf into a full package P of a fixed length. Each winding unit 52 comprises a cradle 54 for gripping the winding bobbin Bf and the traverse drum 55 (drive drum) for traversing the yarn Y unwound from the supply bobbin E. The cradle 54 comprises a movable arm 56 and a fixed arm 57 for respectively gripping opposite ends of the winding bobbin Bf, both arms 56,57 being provided on each winding unit 52. The movable arm 56 is moved in an axial direction of the traverse drum 55 to cooperate with the fixed arm 57 in installing and removing the winding bobbin Bf. In addition, a handle 56A is attached to a side end of the movable arm 56 and extends toward a front side H of the winding unit 52. The traverse drum 55 contacts frictionally with and rotates the package P formed by rewinding the yarn Y around the winding bobbin Bf. The winding bobbin with the yarn Y wound thereon is denoted by Bf, and the winding bobbin without the yarn Y is denoted by B.

In addition, each winding unit 52 comprises the hairiness controlling device 1, a yarn joining device 58, a waxing device 59, a yarn trap 60, and a slab catcher 61 arranged in this order from the supply bobbin E side along a yarn running path between the supply bobbin E and the traverse drum 55. The hairiness controlling device 1 comprises the twist stopping device 4, the gripping guide 5, and the false twisting device 2 having the yarn holding guide 3, and the twist stopping device 4, the gripping guide 5 and the false twisting device 2 are arranged in this order from the supply bobbin E side to the traverse drum 55 side. Additionally, the gripping guide 5 and the yarn holding guide 3 of the hairiness controlling device 1 are connected to the cam mechanism of each winding unit 52. The cam mechanism causes the yarn joining device 58 and other devices to perform a series of operations before starting the rotation of the traverse drum 55, thereby pivoting the yarn holding guide 3 of the hairiness controlling device 1. Pivoting the yarn holding guide 3 causes the yarn Y to be captured and pushed in and held between the disks 6 of the false twisting device 2. Once the series of operations of the cam mechanism have been completed, an urging force from an electromagnet or the like is used to maintain the operational state of the yarn holding guide 3 to keep holding the yarn Y. The yarn trap 60 sucks the yarn Y during the standby state shown in FIG. 7 and acts as a rely pipe for sucking and capturing the yarn Y at the standby position in FIG. 7 for yarn cutting or between the false twisting device 2 and the gripping guide 5 for replacement of the supply bobbin B before introducing the yarn into the yarn joining device 58. The slab catcher 61 detects a defect in the yarn Y and has a function for cutting the yarn Y. 62 is a suction mouth for sucking and capturing the yarn end on the package P side and introducing it into the yarn joining device 58.

The doffing device 53 runs above each winding unit 52 along a rail 64 of a pillar 63 and stops over a winding unit 52 with a full package P to doff the full package P and set the yarn on the empty bobbin B. The doffing device 53 comprises a yarn pick-up device 65 for picking up the yarn Y, a clamp cutter 66 for gripping and cutting the yarn Y, an opener 67 for opening and closing the cradle 54, and a winding bobbin supplying device 68 for supplying the winding bobbin B to the cradle 54.

The yarn pick-up device picks up the yarn Y from between the full package P and the traverse drum 55 and comprises a guide arm 69 and a guide wire 70. The guide arm 69 is pivoted around a drive shaft of the doffing device 53 and located above the traverse drum 55 with the guide wire 70. Additionally, the guide wire 70 is rotatably journaled to a tip of the guide arm 69 and oscillated in the axial direction of the traverse drum 55. The clamp cutter 66 is pivoted around the drive shaft of the doffing device 53 to cut the yarn Y picked up by the yarn pick-up device 65, while gripping the yarn Y on the supply bobbin E side. The opener 67 is pivoted around the drive shaft of the doffing device 53 to come in contact with an inside of the handle 56A of the movable arm 56. In addition, the opener 67 is oscillated in the axial direction of the traverse drum 55 to move the movable arm 56 to open and close the cradle 54. Additionally, the winding bobbin supply device 68 comprises a presser lever 72 for rotating a stocker 71 journaled to the pillar 63 toward the cradle 54, and a presser rod 73 rotated with the presser lever 72 to hold the winding bobbin B in the stocker 71. The stocker 71 is provided for each winding unit 52 to house a plurality of winding bobbins B and is urged toward the doffing device 53 by means of a spring or the like (not shown in the drawings). Controls including control of the rotation speed of the disks 6 of the hairiness controlling device 1 and control of driving of the traverse drum 55 are provided by the controller 40.

Next, the operation of the hairiness controlling device 1 will be described with reference to the drawings in connection with the doffing operation (yarn threading operation) and rewinding operation in the automatic winder 51.

Doffing Operation (Yarn Treading Operation) in the Automatic Winder 51

Once the package P rewound by each winding unit 52 has become full, the winding unit 52 with this package stops the traverse drum 55 (stops winding the yarn Y), pivots the cradle 54 to space the full package P from the traverse drum 5, and lights a doffing request lamp LP. Simultaneously with the spacing of the full package P, a package brake (not shown in the drawings) is applied to stop rotating the package P to prevent the yarn Y from loosening. The doffing device 53, running above each winding unit 52, stops above the winding unit 52 with the doffing request lamp LP lighting and starts the doffing operation (see FIG. 7).

Figure 8:
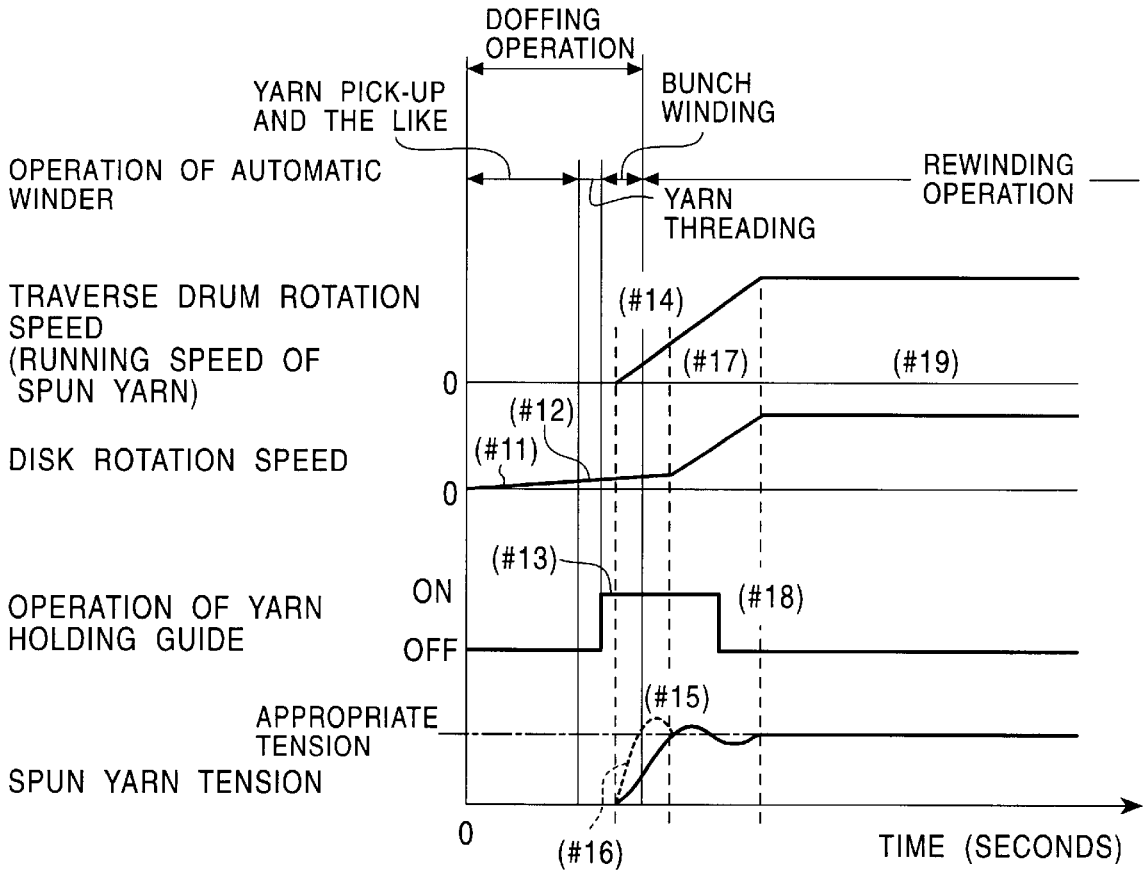
FIG. 8 is a time chart useful in explaining the operation of the hairiness controlling device of the winder in FIG. 7 in connection with a doffing operation (a yarn threading operation), a rewinding operation, and other operations.

After the doffing request lamp LP has been lighted, each disk 6 of the false twisting device 2 is rotated at a low speed in the same direction with the yarn Y placed between the disks 6 (#11 in FIG. 8).

When each disk 6 rotates at a low speed, the yarn Y is subjected to a force that feeds it from the supply bobbin E side to the package P side. In addition, when each disk 6 rotates at a low speed, a rotational force acting on the yarn Y can be reduced to prevent the yarn Y from jumping out from between the disks 6 even if the yarn Y is not running at a high speed, that is, even if the tension exerted on the yarn Y is low. Each disk 6 rotates at a constant low speed or at a low speed that increases gradually with a linear gradient, and this rotation is maintained during the doffing operation (the yarn threading operation of the doffing operation).

Figure 9A:
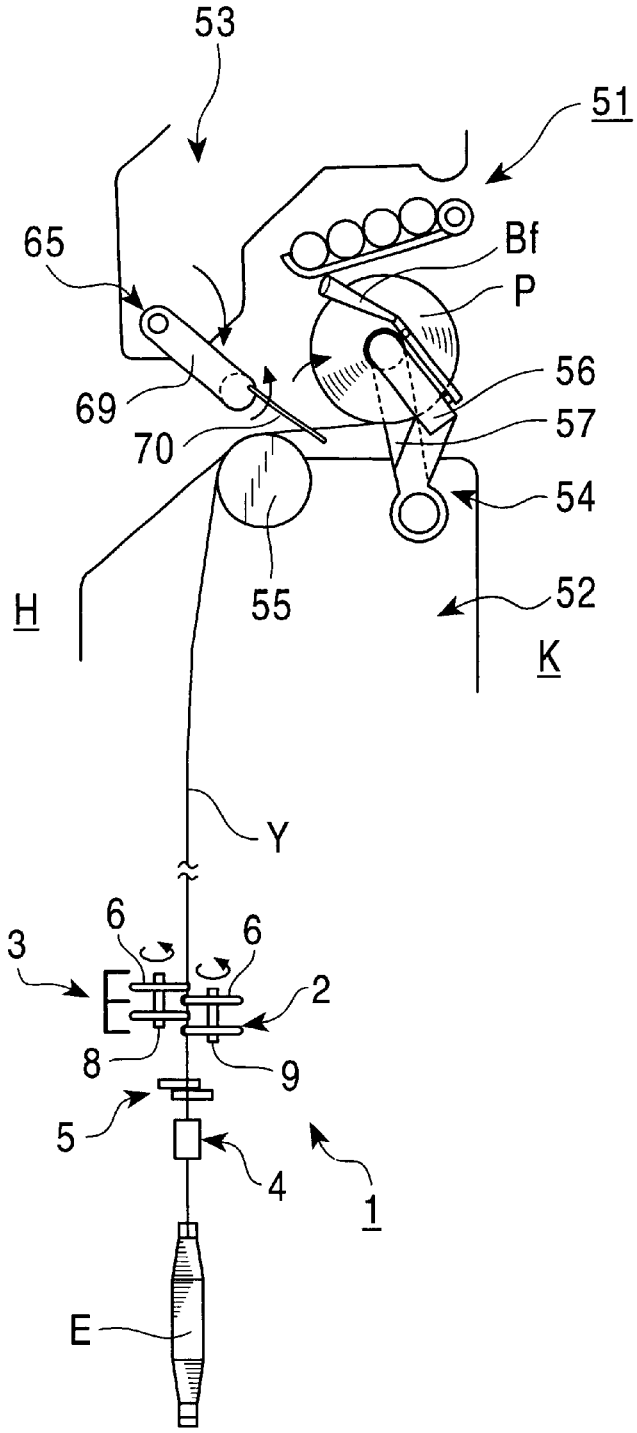
FIG. 9 is a schematic view showing the doffing operation (a yarn pick-up operation) performed by a doffing device of the automatic winder in FIG. 7.

When the doffing device 53 arrives at the winding unit 52 with the lamp LP lighting and the doffing operation is started, the doffing device 53 operates the yarn pick-up device 65 to pivotally lower the guide arm 69 and the guide wire 70 to above the traverse drum 55 (see FIG. 9A).

Figure 9B:
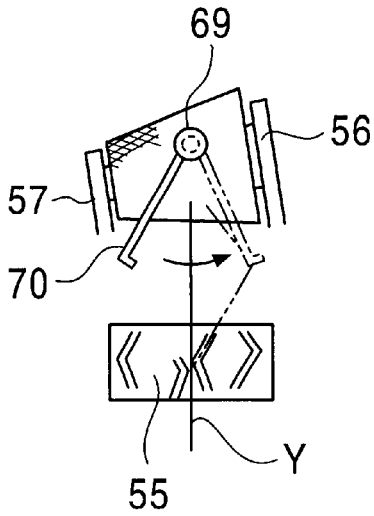

The guide wire 70 is then oscillated in the axial direction of the traverse drum 55 to pick up the yarn Y from between the traverse drum 55 and the full package P and move it to the movable arm 56 (see FIG. 9B).

Figure 10A:
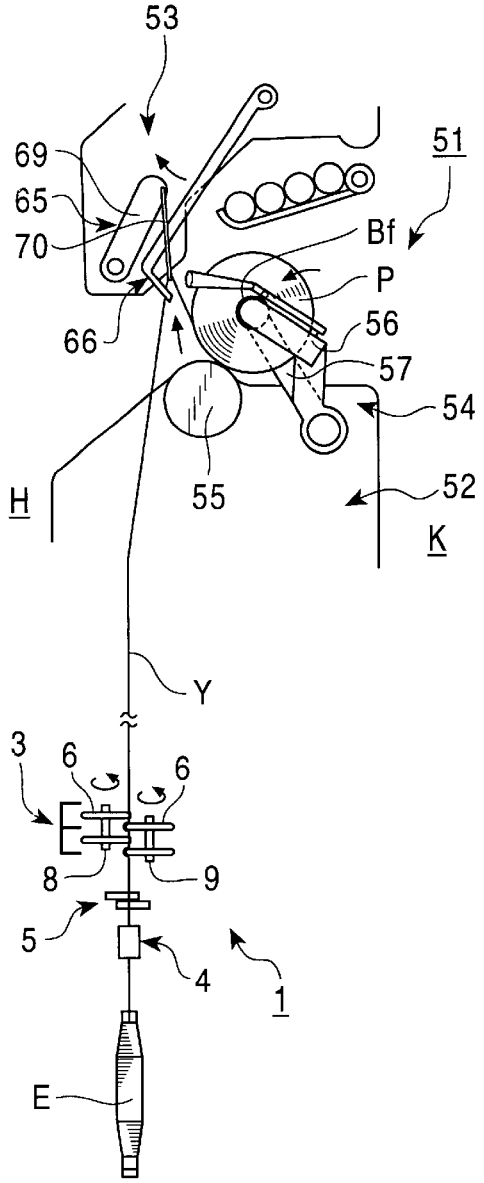
FIG. 10 is a schematic view showing the doffing operation (a yarn pull-up operation) performed by the doffing device of the automatic winder in FIG. 7.

After the guide wire 70 has picked up the yarn Y, the guide arm 69 is pivotally elevated to pull up the picked yarn Y from the traverse drum 55 to a neighborhood of the clamp cutter 66. The cradle 54 is also pivoted to bring the full package P into contact with the traverse drum 55 (see FIG. 10A).

Figure 10B:
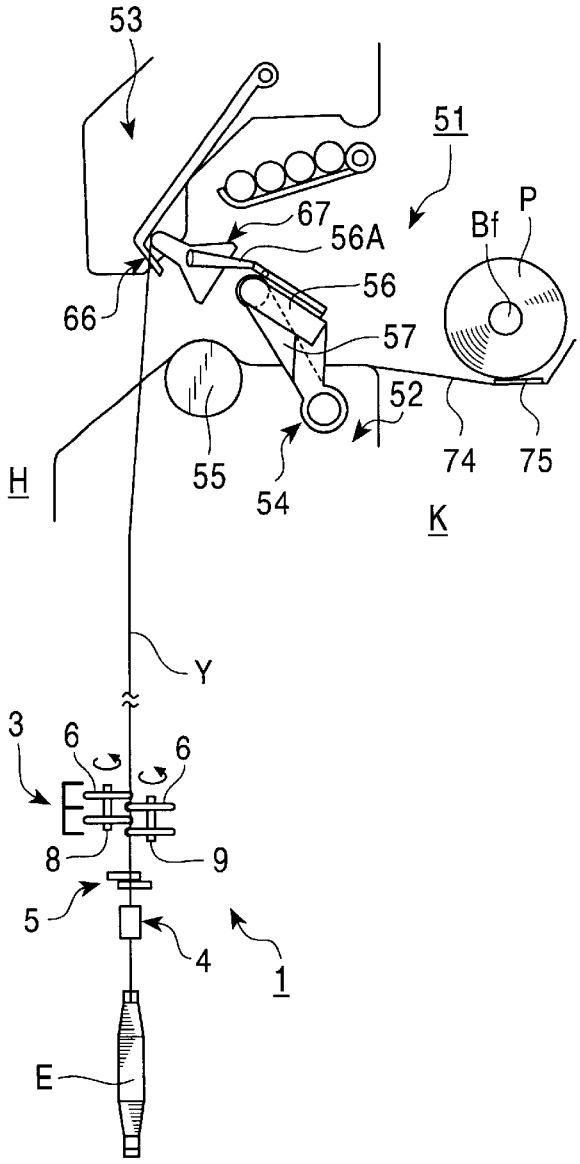

The doffing device 53 subsequently operates the clamp cutter 66 to cut a portion of the yarn Y pulled up by the guide wire 70 while gripping the yarn Y on the supply bobbin E side. By pivotally lowering the opener 67 to abut it on the handle 56A and oscillating the opener 67 to open the cradle 54, the full package P is unloaded onto a guide plate 74 on a rear K side of the winding unit 52. Due to its weight, the unloaded full package P rolls on the guide plate 74 and onto a transfer conveyor 75 (see FIG. 10B).

During the series of doffing operation such as the yarn pick-up and the yarn pull-up, the yarn Y on the supply bobbin E threaded through the disks 6 of the hairiness controlling device 1 is moved toward the package P. At this point, since the yarn Y threaded through the disks 6 is subjected to a feeding force originating in the slow rotation of each disk 6, the contact resistance between the yarn Y and the disk 6 is kept low even when the yarn Y is moved toward the package P, thereby allowing the yarn Y to be smoothly fed toward the package P. Thus, breakage of the yarn Y can be reduced to enable the doffing operation to be reliably performed. In particular, with a thin yarn Y, the yarn Y is likely to be broken due to the yarn pull-up and a rise in the tension caused by the resistance between the yarn Y and each disk 6. Thus, the yarn breakage can be reduced by rotating each disk 6 at a low speed.

Figure 11A:
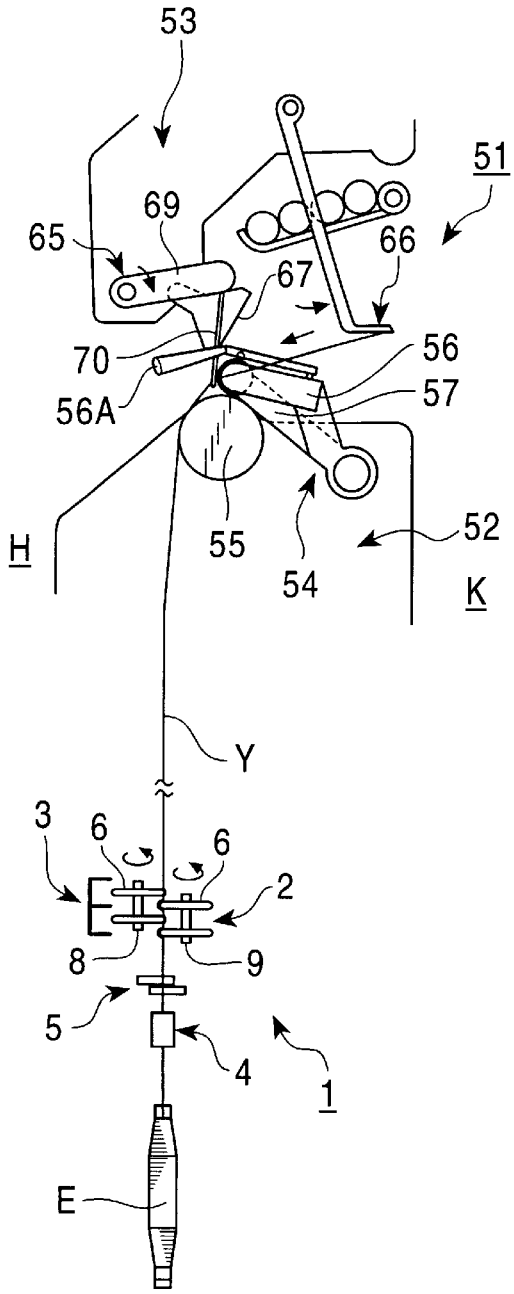
FIG. 11 is a schematic view showing the doffing operation (a yarn threading operation) performed by the doffing device of the automatic winder in FIG. 7.

Once the operation for unloading the package P has been completed, the doffing device 53 starts the winding bobbin supply operation and the yarn threading operation. These operations are performed as follows: The opener 67 is oscillated to close the cradle 54, which is pivoted to a position where it comes in contact with the traverse drum 55. Then, the guide arm 69 is pivotally lowered to move a portion of the yarn Y picked up by the guide wire 70, to a neighborhood of the movable arm 56. By pivoting the clamp cutter 66 toward a rear K side of the movable arm 56 in this state, the yarn Y connected to the supply bobbin E is traversed by a neighborhood of the inside of the movable arm 56 (see FIG. 11A).

Figure 11B:
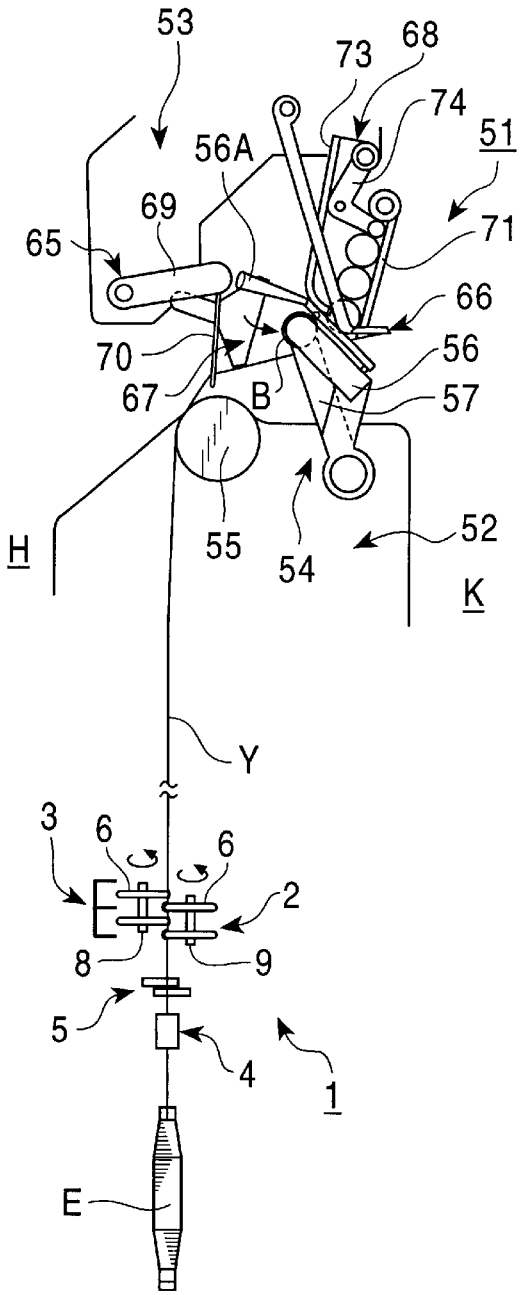

The cradle 54 and the opener 67 are subsequently spaced from the traverse drum 55, and the opener 67 is oscillated to open the cradle 67. The winding bobbin supply device 68 is then operated to pivotally lower the presser lever 72 to oscillate the stocker 71 toward the cradle 54. The stocker 71 is thus inclined downward to locate the leading winding bobbin B between the arms 56,57. By oscillating the opener 67 in this state, the cradle 54 is closed to grip the winding bobbin B. Simultaneously with the gripping of the winding bobbin B, the yarn Y traversing the neighborhood of the inside of the movable arm 56 is sandwiched between an end of the winding bobbin B and the movable arm 56 and set on the winding bobbin B (see FIG. 11B).

During the series of yarn threading operation such as the one by the clamp cutter 66, the yarn Y on the supply bobbin E is pulled up toward the rear K side of the winding unit 52. At this point, since the yarn Y threaded through the disks 6 of the hairiness controlling device 1 is subjected to a feeding force originating in the slow rotation of each disk 6 and acting in the direction in which the yarn Y is pulled up, the contact resistance between the yarn Y and the disk 6 is kept low even when the yarn Y is pulled up, thereby allowing the yarn Y to be smoothly pulled out toward the traverse drum 55 side. Thus, breakage of the yarn Y can be reduced to enable the yarn threading operation to be reliably performed.

Figure 12A:
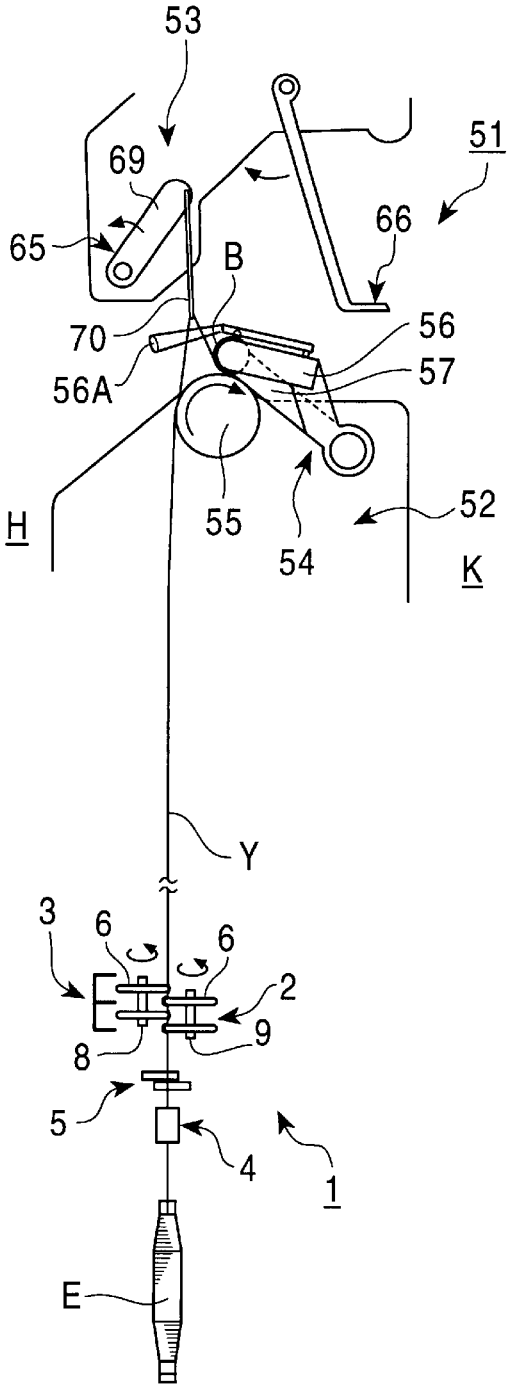
FIG. 12 is a schematic view showing the doffing operation (a bunch winding operation) performed by the doffing device of the automatic winder in FIG. 7.

Once the yarn threading operation has been completed, the yarn Y is released, which has been gripped by the clamp cutter 66. The cradle 54 is pivoted toward the traverse drum 55 and the presser rod 74 is pivotally elevated, so that the urging force of the spring causes the stocker 71 to be spaced from the cradle 54. At this point, the presser rod 74 holds the winding bobbin B so that it will not fall from the stocker 71. The winding bobbin supply device 68 is withdrawn, and the clamp cutter 66 is withdrawn to the doffing device 53. At the same time, the guide wire 70 is pivotally raised to preclude the yarn Y from loosening and is located so as to extend along a bunch guide (not shown in the drawings) of the movable arm 56. In addition, the traverse drum 55 is rotated at a low speed for a short period until the winding bobbin B on the cradle 54 comes in contact with the traverse drum 55. Once the cradle 54 has pivoted enough to bring the winding bobbin B into contact with the traverse drum 55, the yarn Y tensioned by the guide wire 70 is rewound around the winding bobbin B for bunch winding (see FIG. 12A).

Figure 12B:
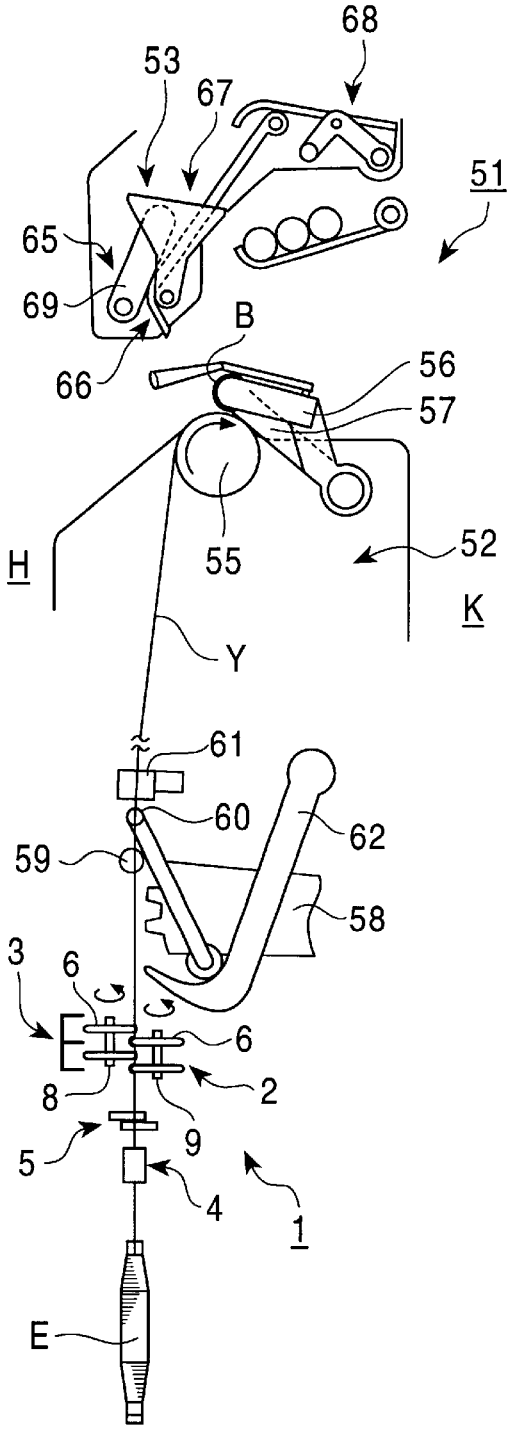

Once the bunch winding has been completed, the guide arm 69 is pivotally lowered to move the guide wire 70 toward the traverse drum 55 and the guide wire 70 is oscillated to release the yarn Y. The yarn pick-up device 65 is withdrawn to the doffing device 53, while the winding unit 52 simultaneously starts to rewind the yarn Y (see FIG. 12B). Yarn Rewinding Operation by the Automatic Winder 51:

Once the doffing device 53 has completed the series of doffing operations, the winding unit 52 starts the rewinding operation. During an initial period of the rewinding operation, each disk 6 of the false twisting device 2 is rotated in the same low speed as in the doffing operation and the yarn threading operation (#12 in FIG. 8).

Each of the yarn holding levers 14 to 16 of the yarn holding guide 3 is then pivoted to move the yarn Y in the guide groove 19 so as to hold it in the central portion A between the disks 6 of the first to third shafts 7 to 9 (#13 in FIG. 8; see FIG. 2). The yarn holding guide 3 is operated when the bunch winding starts.

The yarn Y is contacted with each disk 6 in a fashion being bent zigzag and is subjected to a feeding force from each disk 6 due to its slow rotation.

The traverse drum 55 is subsequently rotated to unwind and run the yarn Y from the supply bobbin E in order to start rewinding following the bunch winding. The rotation speed of the traverse drum 55 is raised with a rapidly increasing linear gradient until it reaches a high value required for rewinding.

In addition, the rotation speed of each disk 6 is raised with a more gradually increasing linear gradient than that of the traverse drum 55 (#14 in FIG. 8).

The yarn Y runs from the supply bobbin E, through the twist stopping device 4 and the gripping guide 5, and through the disks 6 of the false twisting device 2 before being rewound around the winding bobbin B into the package P, the bobbin B being rotated by the traverse drum 55. The yarn Y is also rewound while being traversed by the traverse drum 55 (see FIG. 12B).

In this case, since the contact resistance between the yarn Y and each disk 6 has been reduced because of the slow rotation of each disk 6, the resistance between the disks 6 is kept low even after the yarn Y has started running, thereby allowing the yarn Y to be smoothly fed to the winding bobbin Bf. Consequently, the breakage of the yarn Y can be reduced when rewinding starts.

In addition, when running through the disks 6 of the false twisting device 2, the yarn Y is held by each of the yarn holding levers 14 to 16 of the yarn holding guide 3 to keep stable running, while being simultaneously falsely twisted as each disk 6 rotates. In this case, the twist stopping device 4 regulates propagation of twisting toward the supply bobbin E to effectively falsely twists the yarn Y (see FIG. 2). Accordingly, the yarn Y has its hairiness intertwined with its fibers and thus suppressed.

Simultaneously with the false twisting, the yarn Y is fed to the package P as each disk 6 rotates, and is rewound while maintaining the tension at an appropriate value (#15 in FIG. 8).

The tension of the yarn Y arises from the rotation speed of the disk 6 and the running speed of the yarn Y based on the rotation of the traverse drum 55. That is, it arises from the amount of feeding of the yarn Y based on the rotation of the disk 6 and from the amount of rewinding of the yarn Y based on the rotation of the traverse drum 55. The running speed of the yarn Y will be described below as the rotation speed of the traverse drum 55.

First, when the difference in rotation speed between the rotation speed of the traverse drum 55 and the rotation speed of the disk 6 increases relatively, the amount of rewinding of the yarn Y increases compared to the amount of feeding of the yarn Y, thereby causing the yarn Y to be tensed between the false twisting device 2 and the package P to increase the tension. Alternatively, when the difference in rotation speed decreases relatively, the amount of feeding of the yarn Y increases relatively, thereby causing the yarn Y to be loosened between the false twisting device 2 and the package P to lessen the tension. Consequently, when winding is started, the rotation speed of each disk 6 is raised with a gradually increasing linear gradient while the rotation speed of the traverse drum 55 is raised with a rapidly increasing linear gradient, to rapidly increase the difference in rotation speed between the traverse drum 55 and the disk 6, thereby rapidly raising the tension of the yarn Y. Moreover, after the yarn Y has started to run, the gripping guide 5 may grip and bend the yarn Y to further rapidly raise the tension of the yarn Y to an appropriate value (#16 in FIG. 8).

Subsequently, once the yarn Y rewound into the package P has reached an appropriate tension value, the gradient with which the rotation speed of each disk 6 increases is changed to a rapidly increasing linear one (#17 in FIG. 8). Thus, simultaneously with the start of running of the yarn Y, an operation is started for raising the rotation speed of each disk 6 as the rotation speed of the traverse drum 55 rises, to rapidly set the tension of the yarn Y at an appropriate value. The difference in rotation speed between the traverse drum 55 and the disk 6 is subsequently made constant to maintain the tension of the yarn Y at an appropriate value. In addition, applying an appropriate tension allows the yarn Y to run stably through the disks 6 despite a rotational force of each disk 6, thereby preventing the yarn Y from jumping out from the central portion A between the disks 6.

After the running of the yarn Y has been stabilized, each of the yarn holding levers 14 to 16 of the yarn holding guide 3 is pivoted so as to be spaced from the false twisting device 2, thereby releasing the yarn Y (#18 in FIG. 8; see FIG. 2).

Then, the rotation speeds of each disk 6 and the traverse drum 55 are controlled to constant values to maintain the tension of the yarn Y at an appropriate value, while the yarn Y unwound from the supply bobbin B has its hairiness suppressed and is rewound into the package P (#19 in FIG. 8).

Once the package P has become full, the above described doffing operation is performed by the doffing device 3.

According to the winder of the present invention, the rotation of each disk 6 is started simultaneously with the start of the doffing operation by the automatic winder 51, thereby enabling a reduction in the contact resistance between each disk 6 and the yarn Y between the disks 6. This reduces yarn breakage occurring during the doffing operation (yarn threading operation) when the yarn Y on the supply bob bin E side is pulled up and moved through the disks 6, thereby allowing the doffing operation (yarn threading operation) to be reliably performed.

In addition, during the doffing operation performed by the winder, each disk 6 is rotated at a low speed to set the tension of the yarn Y at an appropriate value.

No complicated control is required to start rotating each disk 6 simultaneously with the start of the doffing operation by the automatic winder 51, allowing the rewinding operation to follow the doffing operation (yarn threading operation).

With the hairiness controlling device according to the present invention, simultaneously with the start of running of the yarn, the operation is started for varying the rotation speed of each of the disks depending on a running speed of the yarn, thereby setting the tension of the yarn at an appropriate value at the start of the running. Applying an appropriate tension allows the yarn to run stably despite the rotational force of each disk to hinder the yarn from jumping out from between the disks, while preventing yarn breakage. Consequently, not only the hairiness controlling process but also the yarn rewinding can be continuously carried out.

With the hairiness controlling device according to the present invention, the rotation speed of each of the disk is raised as the running speed of the yarn rises, so that the rotation speed of each disk and the running speed of the yarn can be raised to corresponding values required for yarn rewinding.

With the hairiness controlling device according to the present invention, each of the disks is rotated at a low speed before the yarn starts to run, thereby reducing yarn breakage caused by the contact resistance between the yarn and each disk when the yarn starts to run.

The hairiness controlling device according to the present invention bends the yarn before running through the disks when the yarn starts to run, thereby the tension of the yarn can be rapidly raised to an appropriate value.

With the hairiness controlling device according to the present invention, the guide means holds the yarn in the central portion between the disks when the yarn starts to run, so that the yarn run through the disks can be stabilized to restrain the yarn from jumping out from between the disks. Consequently, not only the hairiness controlling process but also the yarn rewinding can be continuously carried out.

With the hairiness controlling device according to the present invention, after the tension has been set at an appropriate value to stabilize the running of the yarn, the yarn is released from the guide means. Consequently, the hairiness controlling process or the rewinding can be carried out without excessively damaging the yarn.

With the hairiness controlling device according to the present invention, the guide means pushes and holds the yarn in the central portion between the disks before the start of running of the yarn, thereby further stabilizing the yarn running when the yarn starts to run.

With the winder according to the present invention, by rotating each disk of the hairiness controlling device during the doffing operation by the doffing device, the contact resistance between each disk and the yarn between the disks is lowered to reduce yarn breakage occurring when the supply-side yarn is moved through the disks. The reduction in yarn breakage enables the doffing operation (yarn threading operation) to be reliably performed by the winder. With the wider according to the present invention, each disk is rotated at a lower speed than during normal winding, thereby moving the yarn at a low speed to set the yarn tension at an appropriate value.

With the winder according to the present invention, rotation of each disk is started simultaneously with the start of the doffing operation, thereby eliminating the necessity of complicated control. Consequently, the hairiness controlling process or the yarn rewinding can be carried out without excessively damaging the yarn.

What is claimed is:

1. A hairiness controlling device for rotating a plurality of disks to falsely twist a spun yarn run through the disks while applying a feeding force to the spun yarn, the hairiness controlling device comprising a means for controlling the rotation of the plurality of disks which provides for simultaneously varying the rotational speed of each of said disks, depending on a running speed of said spun yarn, with the start of running of said spun yarn.

2. A hairiness controlling device according to claim 1, characterized in that the rotation speed of each of said disks is raised as the running speed of said spun yarn rises.

3. A hairiness controlling device according to claim 1 or claim 2, characterized in that each of said disks is rotated at a low speed before said spun yarn starts to run.

4. A hairiness controlling device according to claim 1 or claim 2, characterized by having a member for acting on and bending a preceding part of the spun yarn running between said disks.

* * * * *